US008894176B2

(12) United States Patent
Omo

(10) Patent No.: US 8,894,176 B2
(45) Date of Patent: Nov. 25, 2014

(54) PRINTING APPARATUS, METHOD OF CORRECTING IN PRINTING APPARATUS, AND STORAGE MEDIUM STORING PROGRAM THEREOF

(75) Inventor: Shinichi Omo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 446 days.

(21) Appl. No.: 13/033,829

(22) Filed: Feb. 24, 2011

(65) Prior Publication Data

US 2011/0221819 A1 Sep. 15, 2011

(30) Foreign Application Priority Data

Mar. 9, 2010 (JP) ..... 2010-052193

(51) Int. Cl.
*B41J 29/38* (2006.01)
*B41J 2/045* (2006.01)

(52) U.S. Cl.
CPC ..... *B41J 29/38* (2013.01); *B41J 2/0458* (2013.01); *B41J 2/04573* (2013.01); *B41J 2/04541* (2013.01); *B41J 2/04525* (2013.01)
USPC ..... 347/17; 347/19

(58) Field of Classification Search
CPC ..... B41J 2/04525; B41J 2/04541; B41J 2/04573; B41J 2/0458; B41J 29/38
USPC ..... 347/5–20; 399/88; 400/76; 324/613, 324/614
IPC ..... B41J 29/38
See application file for complete search history.

(56) References Cited

U.S. PATENT DOCUMENTS

2004/0183849 A1* 9/2004 Kawatoko ..... 347/19
2006/0146086 A1* 7/2006 Ou et al. ..... 347/17
2006/0221144 A1* 10/2006 Nagashima ..... 347/70
2007/0291081 A1* 12/2007 Kanno et al. ..... 347/61
2008/0143775 A1* 6/2008 Shihoh et al. ..... 347/17
2008/0231651 A1* 9/2008 Jung ..... 347/19
2008/0252674 A1* 10/2008 Ushinohama ..... 347/14

FOREIGN PATENT DOCUMENTS

JP 2001-063028 A 3/2001

* cited by examiner

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

A printing apparatus includes a sensor for detecting temperature of a printhead and outputting the detected temperature as a voltage, and a controller for detecting the voltage, which has been output by the sensor, via a cable and controlling driving of the printhead. The apparatus further includes a switch settable to two states, one in which current is supplied to the sensor and one in which current is not supplied to the sensor; and a correction unit that subtracts a first voltage detected by the controller in a case where the state in which current is not supplied to the sensor has been set by the switch from a second voltage detected by the controller in a case where the state in which current is supplied to the sensor has been set by the switch, thereby obtaining a correction voltage corrected for a crosstalk component produced in the cable.

18 Claims, 11 Drawing Sheets

PRINTING APPARATUS, METHOD OF CORRECTING IN PRINTING APPARATUS, AND STORAGE MEDIUM STORING PROGRAM THEREOF

BACKGROUND OF THE INVENTION

1. Field of the Invention

The present invention relates to a printing apparatus in which the temperature of a printhead is detected, a method of correcting in the printing apparatus and a storage medium storing a program for performing the correction.

2. Description of the Related Art

In general, since an ink-jet printing apparatus prints by discharging ink from a printhead, it is important that the amount of ink discharged be made constant in order to stabilize print density. Since the temperature of the ink changes owing to the fact that heat from the surrounding environment or from the printhead acts upon the ink, the viscosity of the ink varies. It is known that the amount of ink discharged varies as a result of this variation in viscosity. Accordingly, control for maintaining temperature is performed in such a manner that the temperature of the printhead will remain constant. Further, control is exercised so as to hold the amount of discharged ink constant as by measuring the temperature of the printhead (which is equivalent to measuring the ink temperature) and controlling the head driving signal in accordance with the temperature measured. In order to accomplish this, it is vital that the temperature of the printhead be measured accurately. The specification of Japanese Patent Laid-Open No. 2001-63028 describes a method of reading printhead temperature by providing an amplifier, which amplifies the output of a temperature sensor, on a carriage substrate, amplifies the output of the temperature sensor up to a high voltage and then outputs the high-voltage signal.

However, since the foregoing method requires that the amplifier be placed on the carriage substrate, the substrate is of a larger size and higher cost. Further, with the method of detecting printhead temperature by a temperature sensor installed on the printhead, there is an issue that must be taken into account in order to achieve real-time detection of temperature during a printing operation. Specifically, it is necessary to prevent a decline in detection accuracy ascribable to the effects of wiring crosstalk, which is a consequence of a data transfer signal for the purpose of driving the printhead, and the effects of crosstalk resulting from the printhead driving voltage at the time of printing.

SUMMARY OF THE INVENTION

An aspect of the present invention is to eliminate the above-mentioned problems with the conventional technology. The present invention provides a printing apparatus in which the effects of crosstalk are prevented when printhead temperature is detected, a method of correcting in the printing apparatus and a storage medium storing a program for performing the correction.

The present invention in its first aspect provides a printing apparatus having a sensor for detecting temperature of a printhead and outputting the detected temperature as a voltage, and a controller for detecting the voltage, which has been output by the sensor, via a cable and controlling driving of the printhead, the apparatus comprising: a switch settable to two states, one in which current is supplied to the sensor and one in which current is not supplied to the sensor; and a correction unit configured to subtract a first voltage detected by the controller in a case where the state in which current is not supplied to the sensor has been set by the switch from a second voltage detected by the controller in a case where the state in which current is supplied to the sensor has been set by the switch, thereby obtaining a correction voltage corrected for a crosstalk component produced in the cable.

The present invention in its second aspect provides a correction method executed in a printing apparatus having a sensor for detecting temperature of a printhead and outputting the detected temperature as a voltage, a controller for detecting the voltage, which has been output by the sensor, via a cable and controlling driving of the printhead, and a switch settable to two states, one in which current is supplied to the sensor and one in which current is not supplied to the sensor, the method correcting a voltage that has been output by the sensor and comprising: a first setting step of setting the state in which current is not supplied to the sensor; a first detection step of detecting a first voltage that has been output by the sensor in accordance with the current set at the first setting step; a second setting step of setting a state in which current is supplied to the sensor; a second detection step of detecting a second voltage that has been output by the sensor in accordance with the current set at the second setting step; and a correction step of subtracting the first voltage from the second voltage to thereby obtain a correction voltage corrected for a crosstalk component produced in the cable.

The present invention in its third aspect provides a computer-readable storage medium storing a program executed in a printing apparatus having a sensor for detecting temperature of a printhead and outputting the detected temperature as a voltage, a controller for detecting the voltage, which has been output by the sensor, via a cable and controlling driving of the printhead, and a switch settable to two states, one in which current is supplied to the sensor and one in which current is not supplied to the sensor, the program correcting a voltage that has been output by the sensor and causing a computer to function so as to: set a state in which current is not supplied to the sensor and detect a first voltage that has been output by the sensor in accordance with the current set; set a state in which current is supplied to the sensor and detect a second voltage that has been output by the sensor in accordance with the current set; and subtract the first voltage from the second voltage to thereby a correction voltage corrected for a crosstalk component produced in the cable.

In accordance with the present invention, the effects of crosstalk can be prevented when printhead temperature is detected.

Further features of the present invention will become apparent from the following description of exemplary embodiments with reference to the attached drawings.

DESCRIPTION OF THE EMBODIMENTS

Figure 1:
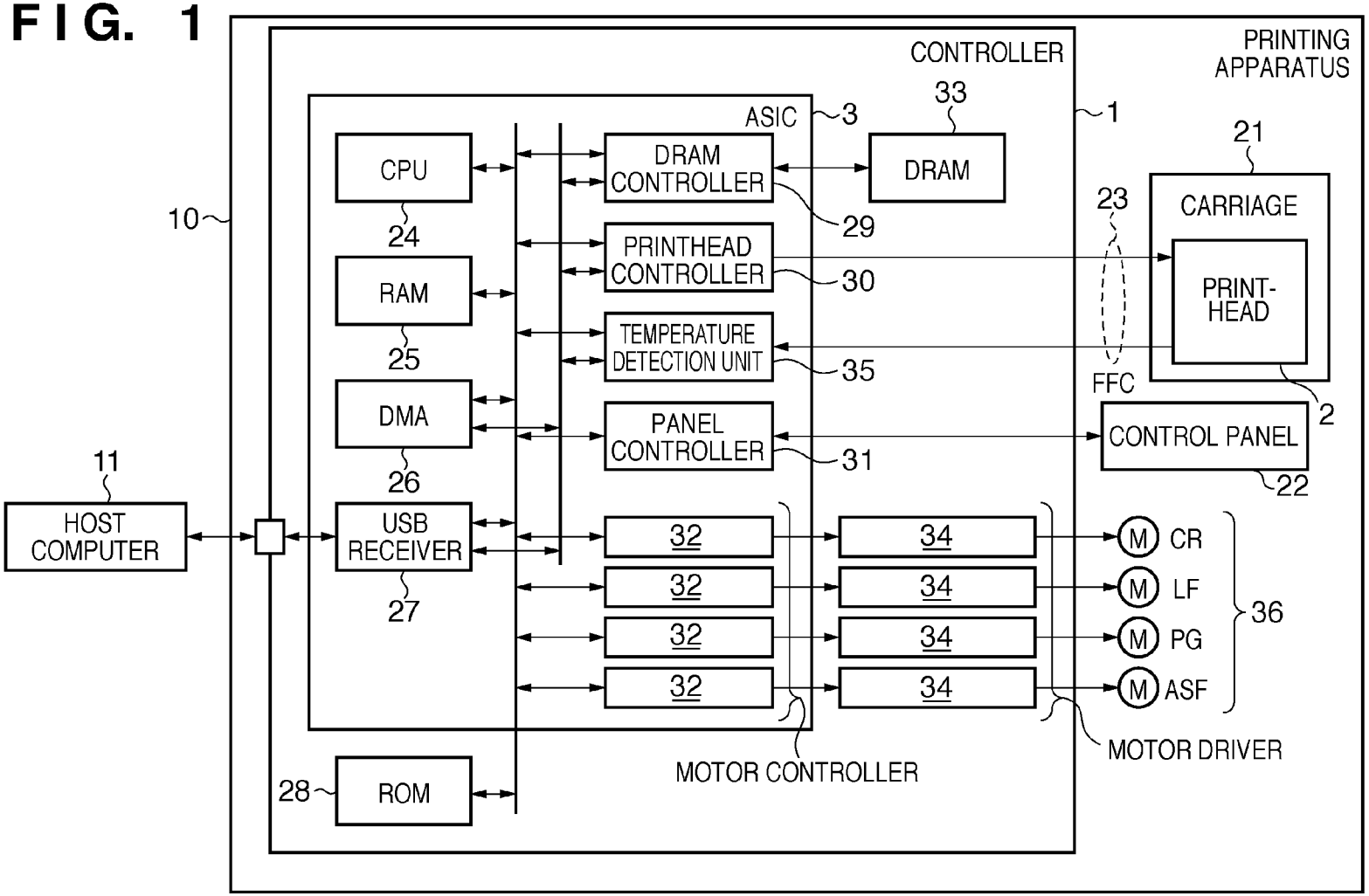
FIG. 1 is a diagram illustrating the configuration of a printing apparatus according to a first embodiment of the present invention.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Identical structural elements are designated by like reference characters and a redundant description thereof is omitted.

First Embodiment

FIG. 1 is a diagram for describing the configuration of a printing apparatus 10 according to an embodiment of the present invention. The printing apparatus 10 has a controller 1 that includes a CPU 24 for overall control of the apparatus. Print data from an external host computer 11 is stored temporarily in a DRAM 33 via a USB receiver 27. Print data that has been stored in the DRAM 33 is read out successively, the data is subjected to command expansion and image data expansion by the CPU 24, a conversion is made to a print-data format in which the data is transferable to a printhead 2 and the results are stored in the DRAM 33 again.

A DMA 26 reads out the print data, which has been stored in the DRAM 33, successively and transfers a print data signal via a printhead controller 30 to the printhead 2 mounted on a carriage 21. The printhead controller 30 further generates and transmits a heater selection signal and a heat pulse signal necessary in order to drive a heater 8 (described later) inside the printhead. A temperature sensor 7 (described later) for detecting the temperature of the printhead also is provided on the printhead 2, amplification and an analog-to-digital conversion are carried out by a temperature detection unit 35, and a heat pulse signal suited to the temperature of the printhead 2 is generated.

The printing apparatus 10 further includes motor drivers 34 for driving carriage motors 36; motor controllers 32 for controlling the motor drivers 34; a control panel 22 for accepting external settings made by the user; a panel controller 31 for controlling the control panel 22; and a RAM 25 and ROM 28 serving as storage areas.

Figure 2:
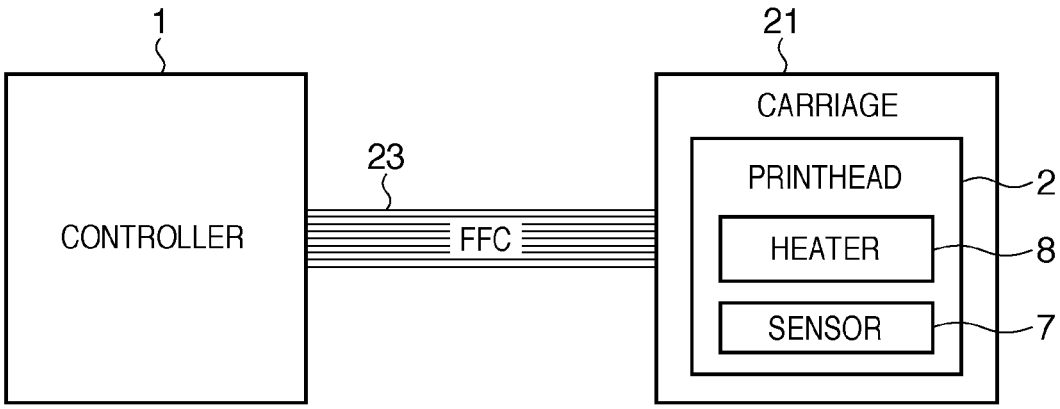
FIG. 2 is a diagram illustrating an overview of a connection between a controller and a carriage.
Figure 3:
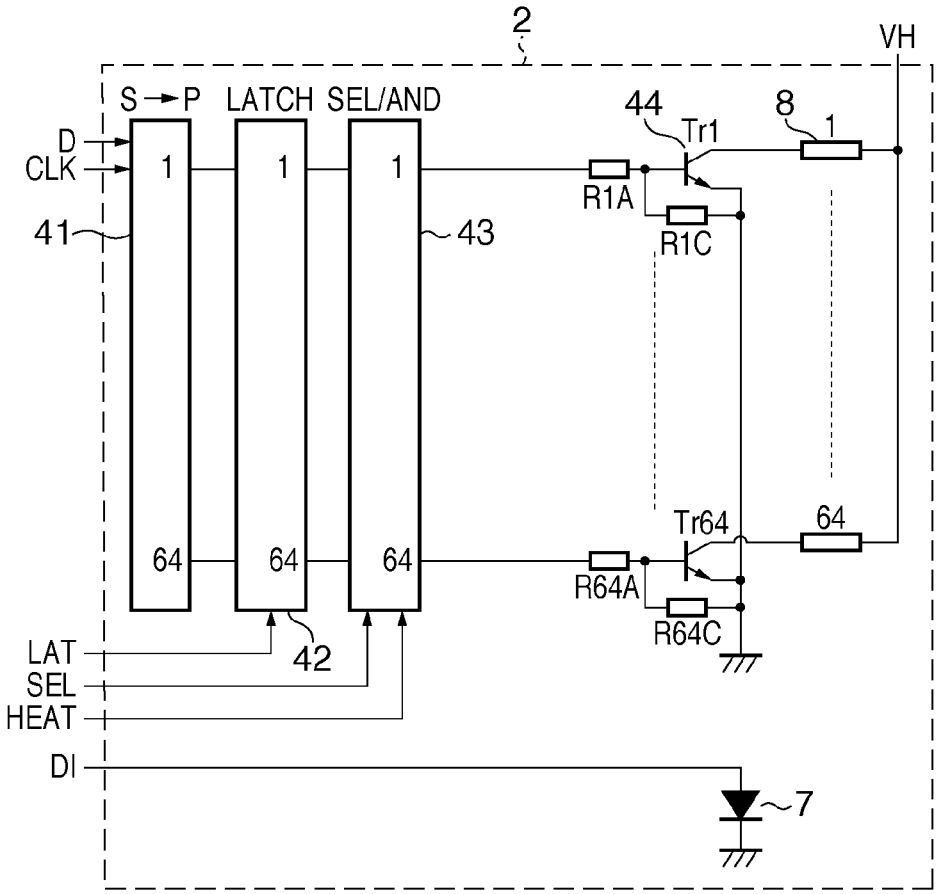
FIG. 3 is a diagram illustrating the configuration of a printhead.

FIGS. 2 and 3 are diagrams for describing the details of the printhead 2. With reference to FIG. 2, the carriage 21 is connected to the controller 1 by a flexible-cable wiring member FFC 23. The print-data signal, heater selection signal, heat pulse signal and head temperature signal are transmitted via the FFC 23, and power for driving the printhead is supplied via the FFC 23. Heaters 8 for discharging ink droplets are mounted on the printhead 2, the number of heaters being equivalent to the number of nozzles. The temperature sensor 7 for measuring the temperature of the printhead is mounted on the printhead 2, the number thereof being one to several as needed.

FIG. 3 is a diagram useful in describing the configuration of the printhead 2 in greater detail. The printhead 2 includes a serial/parallel converter 41 for converting print data, which has been transferred as serial data, to parallel data, and a print data latch 42. The printhead 2 is further provided with a selector 43 for selectively driving a plurality of nozzles in time-shared fashion, a transistor 44 for driving the heater 8, and the temperature sensor 7.

The operation of the printhead 2 will now be described in detail. First, the serial/parallel converter 41 receives print data D synchronized to a print data clock CLK from the controller 1. Next, in response to a LAT signal, the print-data latch 42 latches the print data, which has been converted to parallel data by the serial/parallel converter 41. Next, the selector 43 outputs a drive signal to a heater 8 selected by a selection signal SEL for driving the selected heater in time-shared fashion. The drive signal drives the selected heater 8 by a heat signal HEAT for a prescribed period of time only. The reason for time-shared driving of the heater 8 is for the purpose of suppressing peak current, reducing EMI (emission noise) and reducing peak current capacity of the power supply by diminishing the number of times the heaters 8 are driven simultaneously. Next, the heater 8 is driven by the driver of transistor 44. The temperature sensor 7, which is a diode-type temperature sensor, is provided on the printhead 2 and detects temperature based upon a change in forward voltage versus temperature.

In the ink-jet printing apparatus of this embodiment, there are instances where a printed result is adversely affected as a consequence of a change in ink viscosity with ink temperature. This means that detecting the temperature of the printhead that discharges the ink and controlling the above-mentioned HEAT signal is important in order to stabilize printing.

Figure 4:
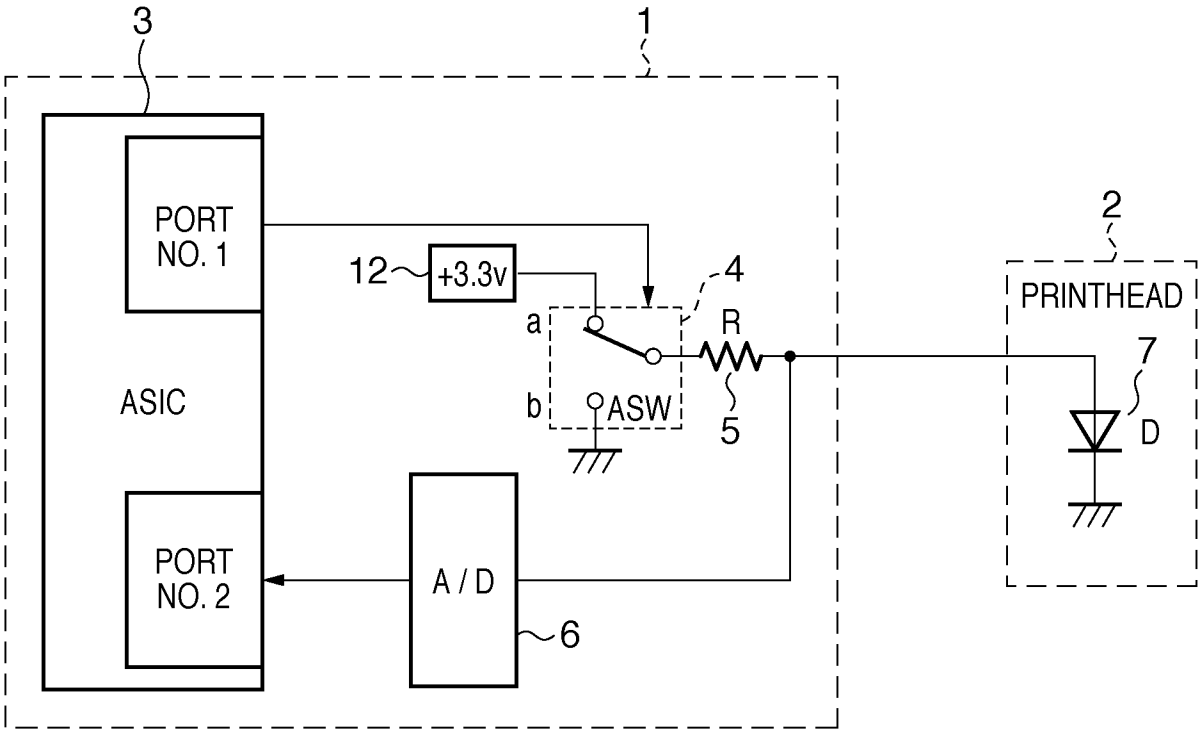
FIG. 4 is a diagram illustrating configuration of a connection between a controller and a carriage in the first embodiment.

FIG. 4 is a diagram useful in describing in detail the connection between the controller 1 and the printhead 2. The controller 1 and printhead 2 are connected by the FFC 23 having a length of 50 cm to 1 m, depending upon the model of printing apparatus. Since the analog output of the temperature sensor 7 is sent to the controller 1 via the long FFC 23, the temperature sensor 7 is affected by crosstalk, which is ascribable to capacitive coupling with the printhead driving signal, owing to stray capacitance among the wiring runs within the FFC 23, and this gives rise to an error in the analog output of the temperature sensor 7. In this embodiment, therefore, a judgment is rendered that voltage prevailing when no current is being passed into the temperature sensor 7 is a cause of error due to crosstalk. The error is then reduced by correcting, based upon this cause of error, voltage detected when a set current has passed through the temperature sensor 7. It should be noted that the controller 1 and printhead 2 are connected in such a manner that their respective ground potentials will be equal. This arrangement holds similarly in other embodiments as well.

Port No. 1 of an integrated circuit 3 such as an ASIC shown in FIG. 4 is an output port. An analog switch (ASW) 4, which is capable of being set to two potentials, namely, +3.3 V (a-side) and 0 V (b-side), is connected to the temperature sensor 7 via a current limiting resistor 5. Connected to terminal a of analog switch 4 is a power supply 12 which generates +3.3 V. Terminal b of the analog switch 4 is connected to ground. The a-side of the analog switch 4 is used when temperature is actually measured, and the b-side is used when crosstalk level is measured. By way of example, assume that the voltage of the temperature sensor 7 is about 0.5 V when the switch 4 has been connected to the a-side (+3.3 V). The voltage drop across the current limiting resistor 5 in this case is 3.3 V−0.5 V=2.8 V. By setting the resistance value of the current limiting resistor 5 to 2.8 KΩ, therefore, the set current can be made about 1 mA.

The output of the temperature sensor 7 is converted to a digital signal by an analog/digital converter 6, the digital signal is read in by CPU 24 (not shown in FIG. 4) via Port No. 2 of the integrated circuit 3, and the temperature is found by referring to a predetermined sensor voltage-temperature conversion table.

Figure 5:
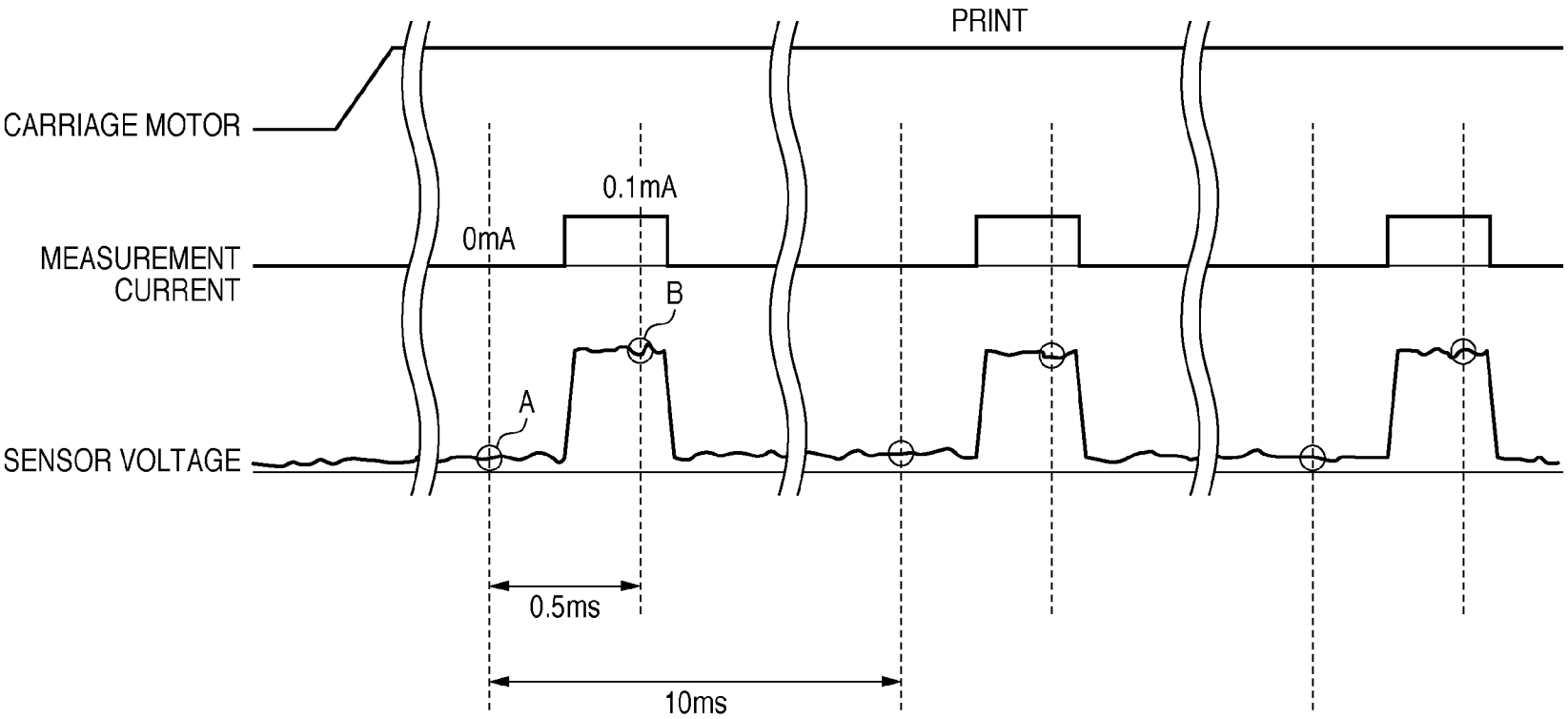
FIG. 5 is a diagram illustrating changes in measurement current and sensor voltage in FIG. 4.

Next, the operation of the arrangement shown in FIG. 4 will be described in detail with reference to FIG. 5. First, the carriage motor 36 for performing printing is driven. This is followed by changing over the analog switch 4 to the b-side to thereby set the measurement current to 0 mA (one example of a first setting). Next, the sensor voltage (first voltage) prevailing at this time is read via the A/D converter 6 and crosstalk voltage V0(A) is found (one example of a first detection). Next, after elapse of 0.5 ms, the analog switch 4 is changed over to the a-side to thereby set the measurement current to 0.1 mA (one example of a second setting). Next, the sensor voltage (second voltage) prevailing at this time is read via the A/D converter 6 and crosstalk voltage V1(B) is found (one example of a second detection). This sensor voltage V1 includes the above-mentioned crosstalk voltage V0 as an error component.

Next, the difference (V1−V0) between the read sensor voltages is found, this is adopted as the sensor-detected result (a correction voltage to which a correction has been applied) and the temperature is determined using the predetermined sensor voltage-temperature conversion table. The reading of temperature described above is performed repeatedly every 10 ms. The value of 0 mA referred to above is an example of a current value at which the temperature sensor will be substantially non-functional; another value may be used if desired. Further, the value of 0.1 mA is an example of a current value for causing the temperature sensor to function; another value may be used if desired. Further, the values of 0.5 ms and 10 ms illustrated in FIG. 5 are examples of set values of time; other values may be used.

Thus, in this embodiment as set forth above, the result of measurement obtained when no current is allowed to flow into the temperature sensor 7 and the temperature sensor is thus rendered non-functional is found as a crosstalk component (error component) produced in the connecting cable, and the actual output from the temperature sensor 7 is corrected based upon this error component. As a result, highly accurate measurement of temperature is possible.

Next, a modification of the first embodiment will be described with reference to FIGS. 10 and 11. Only the difference between FIGS. 4 and 10 will be described, and a description of components in FIGS. 4 and 10 that are identical will be omitted.

Figure 10:
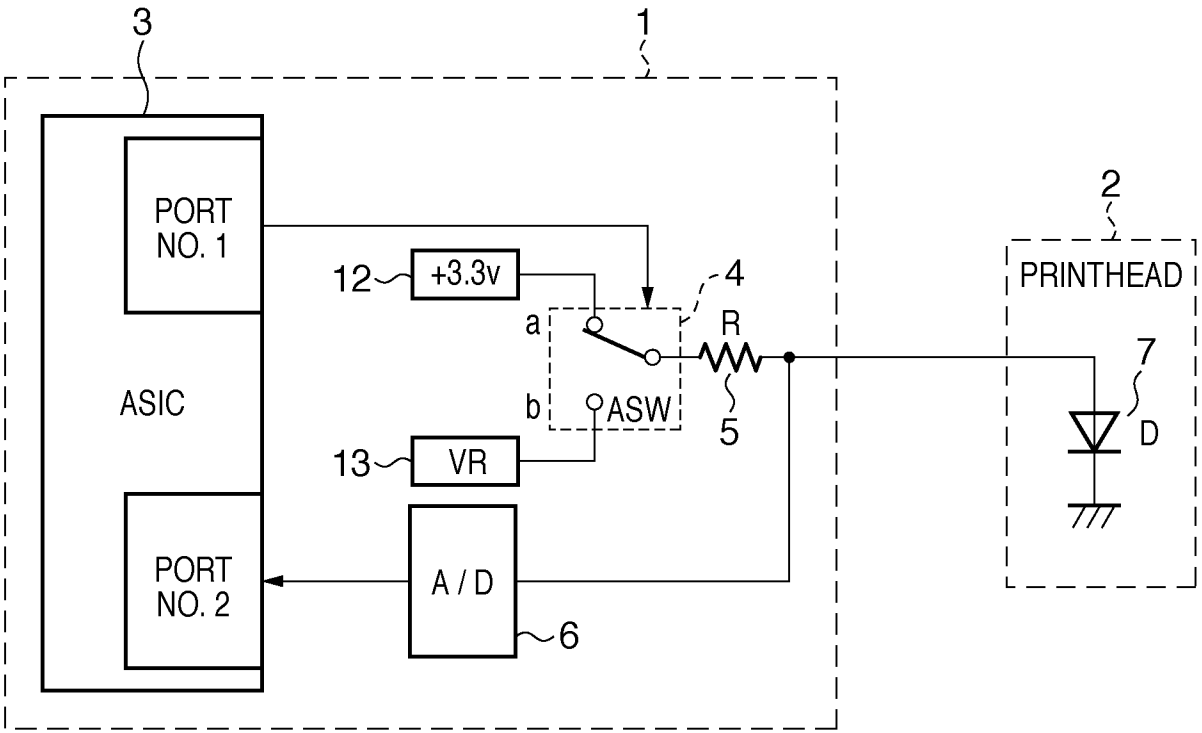
FIG. 10 is a diagram illustrating configuration of a connection between a controller and a carriage in a modification of the first embodiment.
Figure 11:
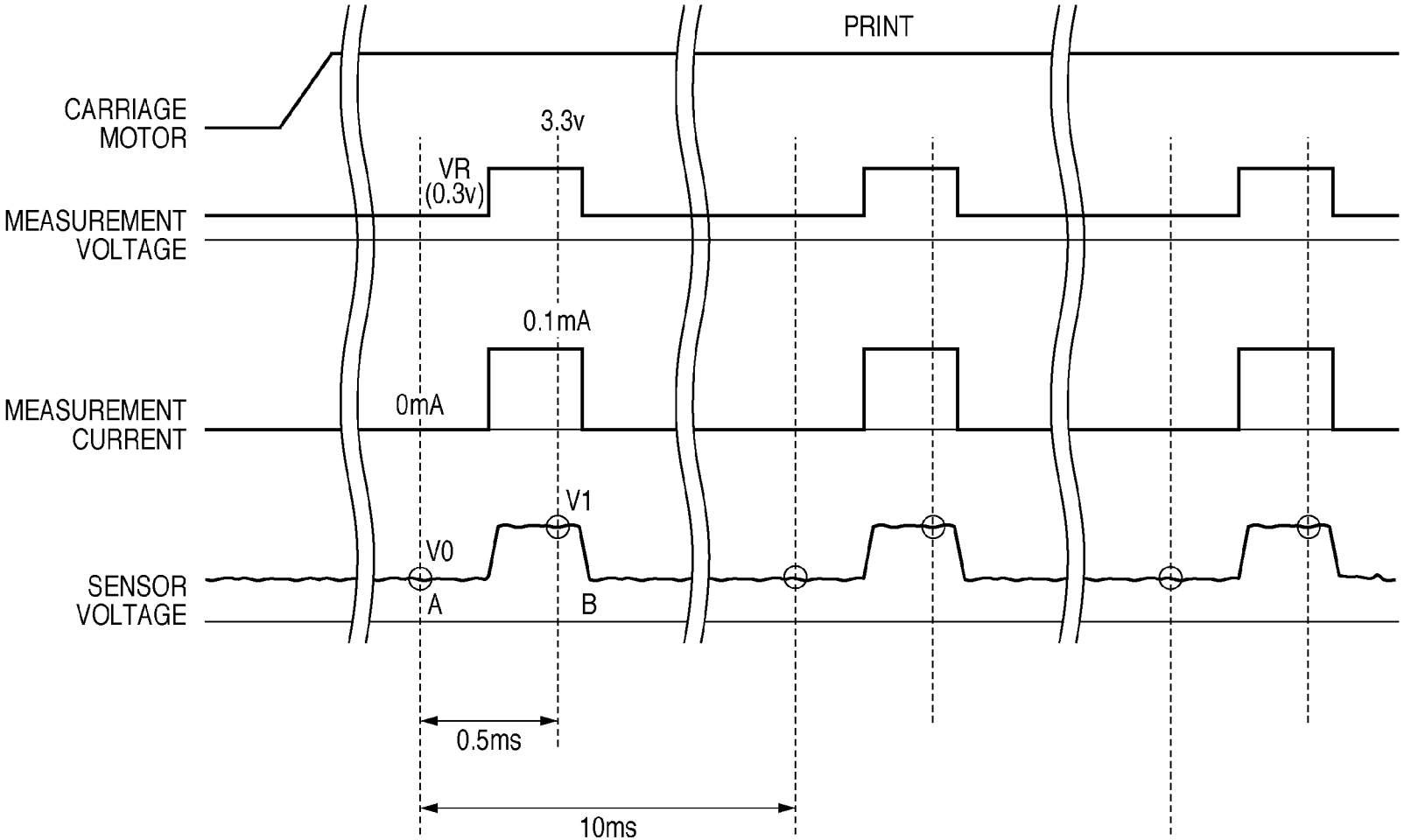
FIG. 11 is a diagram illustrating changes in measurement current and sensor voltage in FIGS. 10.

FIG. 10 differs from FIG. 4 in that terminal b of analog switch 4 is connected to a potential VR (0.3 V). The +3.3-V power supply 12 is connected to terminal a of the analog switch 4, and a power supply 13 for generating 0.3 V is connected to terminal b of the analog switch 4.

If the temperature sensor 7 is a diode, connecting the analog switch to the terminal b will set the switch to a voltage (0.3 V, for example) less than the forward voltage of the diode. As a result, the measurement current can be set to 0 mA.

The operation of the arrangement shown in FIG. 10 will be described with reference to FIG. 11. First, the carriage motor 36 for performing printing is driven. This is followed by changing over the analog switch 4 to terminal b to thereby set the measurement current to 0 mA. Next, the sensor voltage prevailing at this time is read via the A/D converter 6 and crosstalk voltage V0(A) is found. Next, after elapse of 0.5 ms, the analog switch 4 is changed over to terminal a to thereby set the measurement current to 0.1 mA. Next, the sensor voltage (second voltage) prevailing at this time is read via the A/D converter 6 and crosstalk voltage V1(B) is found. This sensor voltage V1 includes the above-mentioned crosstalk voltage V0 as an error component. It should be noted that the voltage V0 includes the voltage VR.

Next, the difference calculation (V1−V0−VR) regarding the sensor voltages is performed, the value calculated is adopted as the sensor-detected result (a correction voltage to which a correction has been applied) and the temperature is determined using the predetermined sensor voltage-temperature conversion table.

Second Embodiment

Generally speaking, the sensor voltage of a temperature sensor that utilizes a diode is such that the slope of the voltage (which corresponds to sensitivity) tends to diminish when current increases. That is, a characterizing feature of such a sensor is that sensitivity is high when there is little current and low when there is much current. On the other hand, enlarging the measurement current of a temperature sensor enables crosstalk-induced impedance to be lowered and the influence of crosstalk to be relatively mitigated. In this embodiment, the aim is to reduce the crosstalk error component by setting the measurement current of the temperature sensor to a suitable value in accordance with the magnitude of the crosstalk level.

Figure 6:
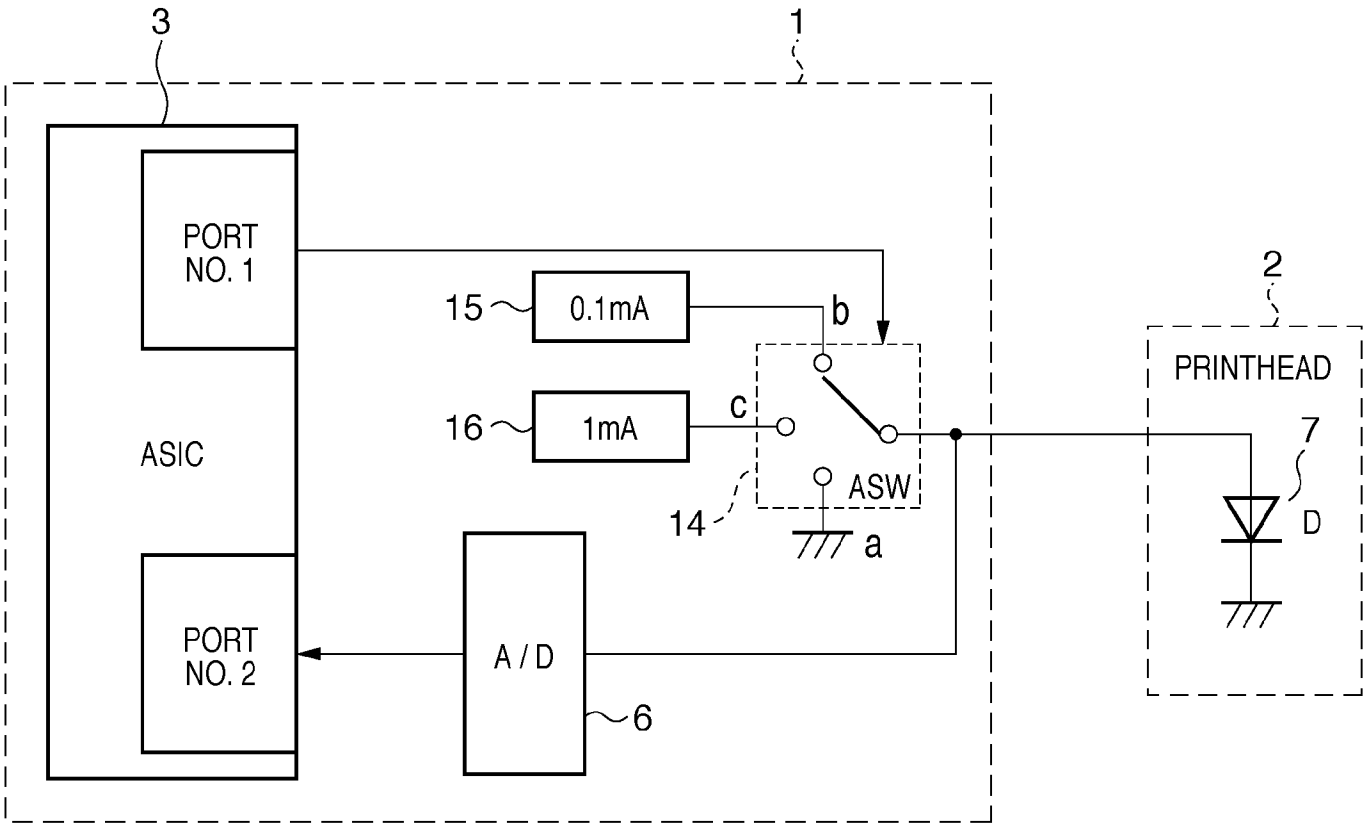
FIG. 6 is a diagram illustrating configuration of a connection between a controller and a carriage in a second embodiment of the present invention.

FIG. 6 is a diagram useful in describing a second embodiment of the present invention. Here an analog switch 14 has a, b and c terminals. This analog switch is such that current values of three levels can be set by selecting among the terminals. A level a is a measurement current of 0 mA and is a current value at which the temperature sensor will be substantially non-functional. A level b is a measurement current of 0.1 mA, and a level c is a measurement current of 1 mA.

Figure 7:
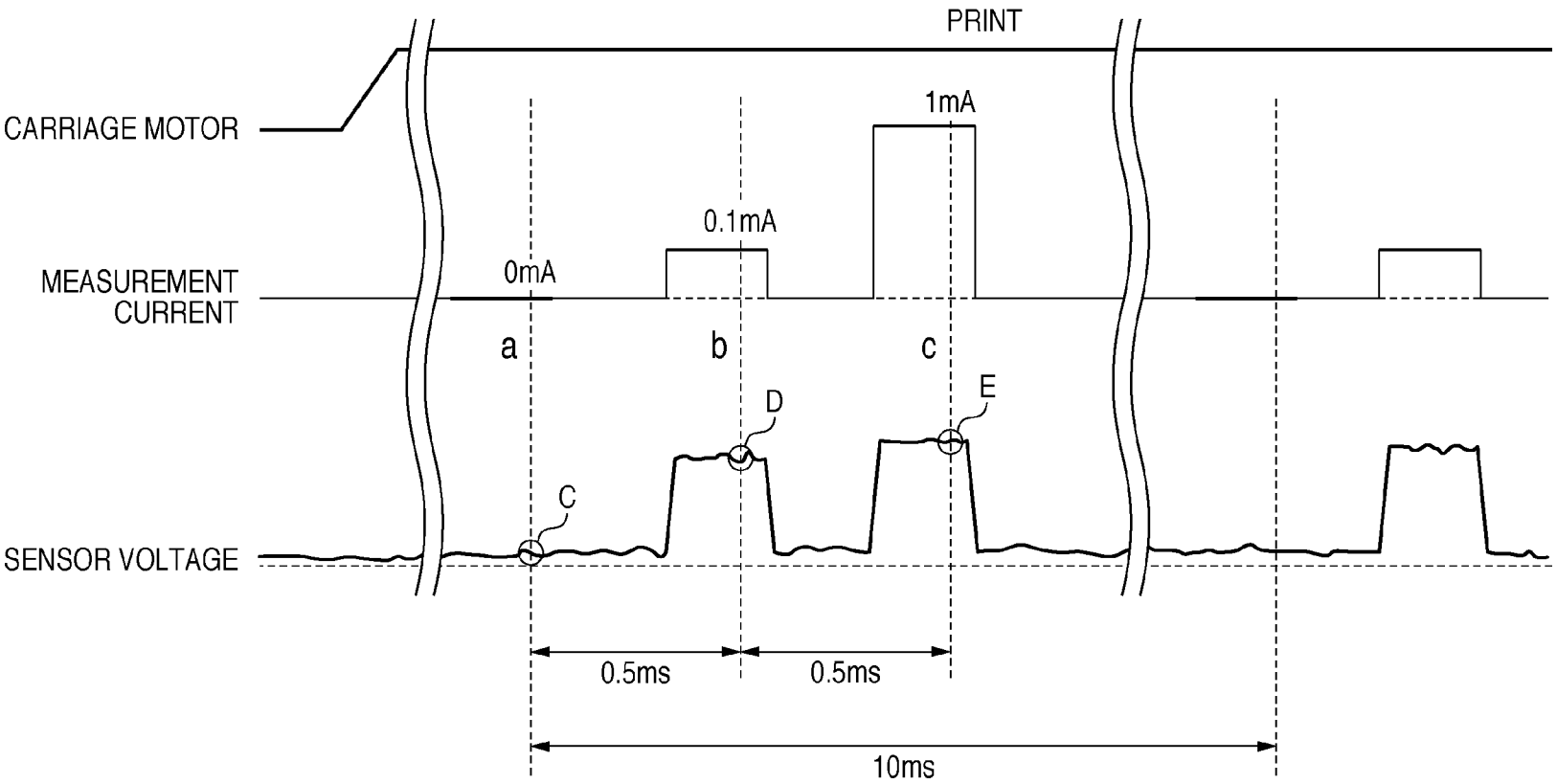
FIG. 7 is a diagram illustrating changes in measurement current and sensor voltage in the second embodiment.

FIG. 7 is a diagram for describing the operation of the arrangement shown in FIG. 6. In a manner similar to that of the first embodiment, measurement of crosstalk is performed by changing over the analog switch to a, b (current source 15) and c (current source 16) successively during printing. As a result, temperature measurement at a measurement current rendered suitable by the obtained crosstalk level is carried out.

The operation of FIG. 7 will be described in detail. First, the carriage motor 36 for performing printing is driven. This is followed by changing over the analog switch 14 to the a-side to thereby set the measurement current to 0 mA. Next, the sensor voltage (first voltage) prevailing at this time is read via the A/D converter 6 and crosstalk voltage V0(C) is found. Next, after elapse of 0.5 ms, the analog switch 14 is changed over to the b-side to thereby set the measurement current to 0.1 mA (first current value). Next, the sensor voltage (third voltage) prevailing at this time is read via the A/D converter 6 and sensor voltage V1(D) containing a crosstalk error component is found. Next, after elapse of 0.5 ms, the analog switch 14 is changed over to the c-side to thereby set the measurement current to 1 mA (second current value). Next, the sensor voltage (second voltage) prevailing at this time is read via the A/D converter 6 and sensor voltage V2(E) containing a crosstalk error component is found. Next, the value of the crosstalk voltage V0 found earlier is compared with a predetermined reference value Vk of measurement current and the two values are compared in size. The sensor voltage V2 is selected if the result is V0<Vk (V0 is less than the reference value), and the sensor voltage V1 is selected if the result is V0>·Vk or V0=Vk (V0 is equal to or greater the reference value). The result of the selection (namely V2−V1 or V1−V0) is adopted as the result of temperature measurement and the temperature is found by referring to the predetermined sensor voltage-temperature conversion table. The operation described above is performed repeatedly every 10 ms as in the first embodiment. The value of 0 mA referred to above is an example of a current value at which the temperature sensor will be substantially non-functional; another value may be used if desired. Further, the values of 0.1 mA and 1 mA are examples of current values for causing the temperature sensor to function; other values may be used if desired. Further, the values of 0.5 ms and 10 ms are examples of set values of time and other values may be used.

Thus, in the second embodiment, temperature measurement is performed at the optimum sensor current in dependence upon the crosstalk error component at such time that no current is allowed to flow into the temperature sensor and the temperature sensor is thus rendered non-functional. For example, in a case where the crosstalk voltage is lower than the reference value, as mentioned above, it is possible to read a temperature the accuracy of which is maintained satisfactorily even in the region where sensitivity is low. In this case, therefore, the sensor voltage V2 measured at the higher measurement current (1 mA) is selected.

On the other hand, in a case where the crosstalk voltage is greater than the reference value, it is necessary to read the temperature while maintaining accuracy in the region where sensitivity is high. In this case, therefore, the sensor voltage V1 measured at the lower measurement current (0.1 mA) is selected. Thus, in this embodiment, the fact that temperature measurement is performed at the optimum sensor current in accordance with the level of the crosstalk voltage means that the accuracy with which temperature is read can be maintained in accordance with the level of the crosstalk error component.

Figure 12:
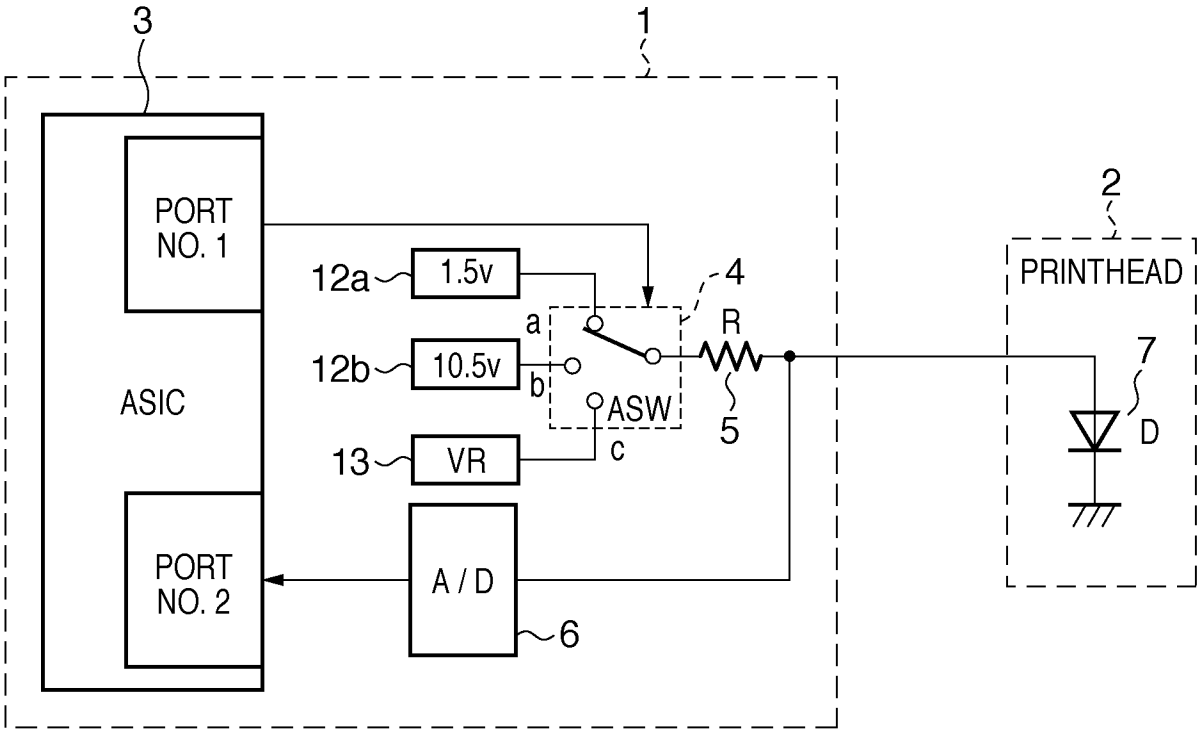
FIG. 12 is a diagram illustrating configuration of a connection between a controller and a carriage in a modification of the second embodiment.

In addition to changing over the current source as described above, a changeover of voltage source and a changeover of resistance are also available and serve as modifications of the second embodiment. A circuit arrangement of the kind shown in FIG. 12 for changing over a voltage source will be described. Changes in measurement current and sensor voltage will be described with reference to FIG. 7. Analog switch 4 is changed over to the side of terminal c to connect the switch to voltage source 13 and set the measurement current to 0 mA. Next, the sensor voltage (first voltage) prevailing at this time is read via the A/D converter 6 and crosstalk voltage V0(C) is found. Next, after elapse of 0.5 ms, the analog switch 4 is changed over to terminal a to connect the switch to a voltage source 12*a* and set the measurement current to 0.1 mA (first current value). Next, the sensor voltage (third voltage) prevailing at this time is read via the A/D converter 6 and sensor voltage V1(D) containing a crosstalk error component is found. Next, after elapse of 0.5 ms, the analog switch 4 is changed over to the terminal b to connect the switch to a voltage source 12*b* and set the measurement current to 1 mA (second current value). Next, the sensor voltage (second voltage) prevailing at this time is read via the A/D converter 6 and sensor voltage V2(E) containing a crosstalk error component is found. It should be added here that the voltage applied to the diode 7 is assumed to be 0.5 V, and the voltage source or resistance value is decided upon in such a manner that the measurement current will take on the values (0 mA, 0.1 mA, 1 mA) described in FIG. 7. For example, the value of resistor 5 is 10 kΩ and the voltages generated by the voltage sources 12*a* and 12*b* are 1.5 V and 10.0 V, respectively.

According to the arrangement described above, the difference value (|V0−VR|) between crosstalk voltage V0 and voltage VR is found and either sensor voltage V1 or V2 is selected based upon the result of the comparison between this difference value and reference value Vk. For example, the sensor voltage V2 is selected if |V0−VR|<Vk holds, and the sensor voltage V1 is selected if |V0−VR|>·Vk holds or |V0−VR|=Vk holds. The temperature is found by referring to the predetermined sensor voltage-temperature conversion table with regard to the sensor voltage selected.

Third Embodiment

Figure 8:
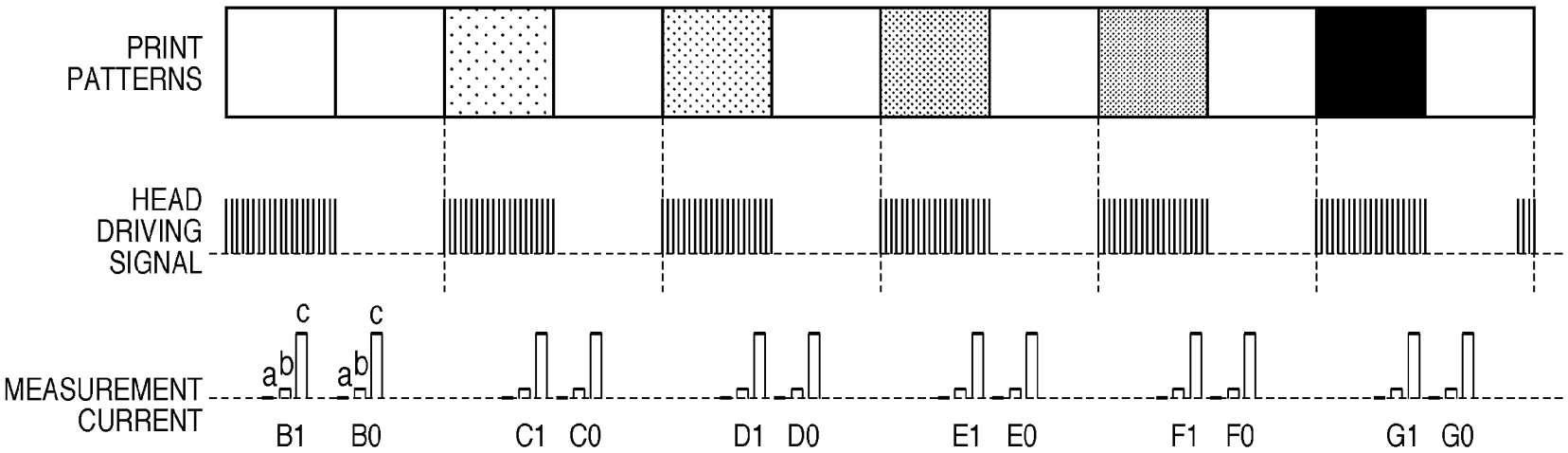
FIG. 8 is a diagram useful in describing measurement currents corresponding to print patterns in a third embodiment of the present invention.

FIG. 8 is a diagram useful in describing a third embodiment for the purpose of raising the measurement accuracy of the second embodiment. Predetermined print patterns which are portions of different print densities are depicted in FIG. 8. Specifically, B1 represents absence of printing, C1 to G1 are print patterns of gradually higher print density, and B0 to G0 represent absence of printing. In other words, a white-paper pattern is inserted between adjacent ones of a plurality of print patterns in which print density changes in turns, and the print patterns and white-paper patterns are output alternatingly.

The third embodiment aims to improve measurement accuracy by obtaining a correction value using predetermined print patterns and correcting the result of measurement using the obtained correction value when an actual temperature measurement is performed.

Character a shown in FIG. 8 represents a state in which the temperature sensor 7 is being driven at a current of 0 mA, b a state in which the temperature sensor 7 is being driven at a current of 0.1 mA, and c a state in which the temperature sensor 7 is being driven at a 1 mA. Further, B1 indicates measurement data influenced by the printhead driving signal but not influenced by the HEAT signal. Further, B0, C0, . . . G0 indicate measurement data influenced by neither the printhead driving signal nor the HEAT signal, and C1, D1, . . . G1 indicate measurement data influenced by both the printhead driving signal and the HEAT signal.

First, at B1 in FIG. 8, where no printing takes place, measurement of the sensor voltage is carried out changing the level of the measurement current to a then b then c in a manner similar to that of the second embodiment. Next, at B0 in FIG. 8, where no printing takes place, measurement of the sensor voltage is carried out changing the level of the measurement current to a then b then c in a manner similar to that of the second embodiment. Next, at C1 in FIG. 8, where light printing takes place, measurement of the sensor voltage is carried out changing the level of the measurement current to a then b then c in a manner similar to that of the second embodiment. Next, at C0 in FIG. 8, where no printing takes place, measurement of the sensor voltage is carried out changing the level of the measurement current to a then b then c in a manner similar to that of the second embodiment. Thereafter, and in similar fashion, printing density is elevated gradually and sensor voltage measured similarly up to F1, F0. At G1 in FIG. 8, where full printing takes place, measurement of the sensor voltage is carried out changing the level of the measurement current to a then b then c in a manner similar to that of the second embodiment. Thus, since measurement at G0 is performed immediately after printing at G1, a change in printhead temperature between G0 and G1 is substantially nonexistent and, hence, the temperature is constant. The same holds true between B1 and B0, . . . , F1 and F0.

Error components ascribable to crosstalk at each of these print densities versus measurement current are found from these obtained results. At G1 and G0, for example, let VG1*a*, VG1*b*, VG1*c*, VG0*a*, VG0*b*, VG0*c* represent the respective measurement values, and let VGa, VGb, VGc represent the respective crosstalk error components at each of the measurement current levels. The crosstalk error components are then calculated according to Equations (1) to (3) below.

$$VGa=VG1a-VG0a \quad (1)$$

$$VGb=VG1b-VG0b \quad (2)$$

$$VGc=VG1c-VG0c \quad (3)$$

It should be noted that since VG1*a* and VG0*a* are voltages that prevail when the temperature sensor is non-operational, these need not be measured in actuality. The crosstalk error components VGa, VGb, VGc represent errors influenced by the HEAT signal and by the printhead driving signal at respective ones of the measurement current levels.

This embodiment applies a correction by further subtracting the above-mentioned VGb or VGc from V1−V0 or V2−V0 (first correction voltage) obtained with regard to the respective measurement current levels (0.1 mA and 1 mA) in the case where the second embodiment is implemented with regard to each of the printing densities. This correction is an example of a second correction in this embodiment. As a result, it is possible to obtain a sensor voltage (second correction voltage) from which has been excluded not only crosstalk voltage that exists when no measurement current is allowed to flow but also error components ascribable to the effects of the HEAT signal and printhead driving signal when measurement current is flowing. This makes more accurate measurement possible.

The correction of this embodiment may be factory-implemented and the correction values (VGa, VGb, VGc) stored in advance, by way of example. Further, it may be arranged so as to implement the correction a single time when power is introduced to the printing apparatus and store the correction values in advance, or so as to implement the correction suitably when printing is quiescent and store the correction values in advance. Further, rather than implement the correction with regard to the printing densities of all of the print patterns shown in FIG. 8, the correction may be implemented with regard to a print pattern (D1, for example) having a specific printing density and the white-paper pattern (D0, for example) that immediately follows it.

Figure 9:
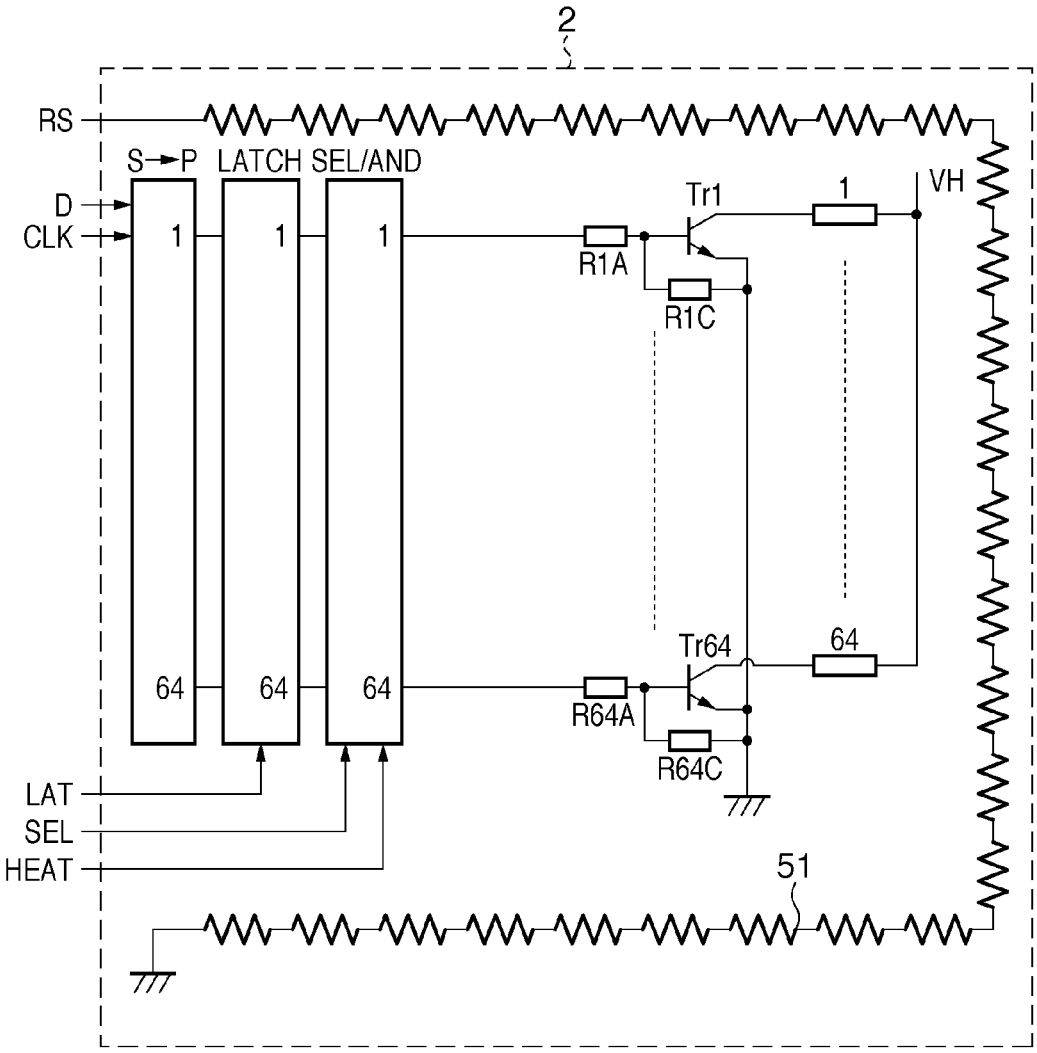
FIG. 9 is a diagram illustrating another example of a printhead.

FIG. 9 shows another example of the temperature sensor 7 which, in this case, uses a resistor 51 formed inside the printhead 2 by a wiring pattern. The sensor shown in FIG. 9 utilizes the fact that the wiring resistance value varies with temperature. It may be arranged so that the temperature of the printhead is found by applying a constant current to an RS terminal of the resistor 51, obtaining the voltage at the RS terminal and finding the printhead temperature in accordance with a predetermined conversion table. Further, and by way of example, a suitable resistor may be connected across a power supply of 3.3 V and the RS terminal of the resistor 51, the voltage at the RS terminal obtained and the printhead temperature found in accordance with a predetermined conversion table. By implementing the correction of the above-described embodiment with regard also to printhead 2 having a temperature sensor that uses the resistor 51 shown in FIG. 9, the accuracy of the temperature reading can be improved.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-052193, filed Mar. 9, 2010, which is hereby incorporated by reference herein in its entirety.

What is claimed is:

1. An apparatus comprising:

an obtaining unit configured to obtain a first voltage which is detected when a first current value is supplied to a sensor for measuring a temperature of a printhead, and a second voltage which is detected when no current value or a second current value which is less than the first current value is supplied to the sensor; and a correction unit configured to specify a correction voltage by correcting the first voltage obtained by the obtaining unit based on the second voltage obtained by the obtaining unit.

2. The apparatus according to claim 1, further comprising a detecting unit configured to detect a voltage output from the sensor via a cable, and wherein the obtaining unit obtains the first voltage and the second voltage detected by the detecting unit.

3. The apparatus according to claim 2, wherein the second voltage is a noise voltage which occurs in the cable.

4. The apparatus according to claim 1, wherein the first voltage and the second voltage are detected while printing by the printhead is performed.

5. The apparatus according to claim 1, further comprising a switch control unit configured to control a switch to change a current value supplied to the sensor.

6. The apparatus according to claim 5, wherein a first terminal of the switch is connected to a power supply for supplying the first current value, and a second terminal of the switch is connected to a ground, and wherein the first voltage is detected in a case where the switch is changed over to the first terminal of the switch, and the second voltage is detected in a case where the switch is changed over to the second terminal of the switch.

7. The apparatus according to claim 5, wherein the sensor is a diode type sensor, and a first terminal of the switch is connected to the first voltage used for measuring a temperature by the sensor and a second terminal of the switch is connected to the second voltage for generating a voltage which is less than a forward voltage of a diode, and wherein the first voltage is detected in a case where the switch is changed over to the first terminal of the switch, and the second voltage is detected in a case where the switch is changed over to the second terminal of the switch.

8. The apparatus according to claim 1, further comprising a determining unit configured to determine a power supply or a resistor used for measuring a temperature based on the second voltage obtained by the obtaining unit and a predetermined reference voltage.

9. The apparatus according to claim 8, wherein, in a case where the second voltage obtained by the obtaining unit is less than the predetermined reference voltage, the determining unit determines the power supply or the resistor such that a current to be supplied to the sensor is larger than that in a case in which the second voltage obtained by the obtaining unit is equal to or larger than the predetermined reference voltage.

10. The apparatus according to claim 8, further comprising a switch control unit configured to control a switch to change a current value supplied to the sensor, wherein a first terminal of the switch is connected to a third power supply for supplying a third current value and a second terminal of the switch is connected to a fourth power supply for supplying a fourth current value which is less than the third current value, and wherein the first voltage is detected by changing over the switch to the first terminal in a case where the second voltage obtained by the obtaining unit is less than the predetermined reference value, and the first voltage is detected by changing over the switch to the second terminal in a case where the second voltage unit obtained by the obtaining unit is equal to or larger than the predetermined reference voltage.

11. The apparatus according to claim 1, further comprising a specifying unit configured to specify the temperature of the printhead based on the correction voltage specified by the correction unit.

12. The apparatus according to claim 11, further comprising a heater control unit configured to control driving of a heater provided in the printhead according to the temperature specified by the specifying unit.

13. The apparatus according to claim 1, wherein the obtaining unit further obtains a voltage of the sensor while printing by the printhead is performed, and a voltage when printing by the printhead is not performed, and wherein the correction unit specifies the correction voltage by correcting the first voltage obtained by the obtaining unit based on the second voltage obtained by the obtaining unit, the voltage of the sensor while printing by the printhead is performed, and the voltage when printing by the printhead is not performed.

14. The apparatus according to claim 1, wherein the obtaining unit obtains the second voltage, for each printing density, when printing is performed by the printhead, and the correction unit specifies the correction voltage for said each printing density.

15. The apparatus according to claim 1, further comprising a storage unit configured to store at least one of the second voltage which is detected when the apparatus is shipped from a factory, the second voltage which is detected when the apparatus is powered-on, and the second voltage which is detected while printing by the printhead is halted, and wherein the obtaining unit obtains the second voltage from the storage unit.

16. The apparatus according to claim 1, further comprising the printhead.

17. A method comprising:

obtaining a first voltage which is detected when a first current value is supplied to a sensor for measuring a temperature of a printhead, and a second voltage which is detected when no current value or a second current value which is less than the first current value is supplied to the sensor; and specifying a correction voltage by correcting the obtained first voltage based on the obtained second voltage.

18. A non-transitory, computer-readable storage medium storing a program for executing a method according to claim 17 in a computer.

* * * * *